US007475879B1

(12) United States Patent
Fernandez et al.

(10) Patent No.: US 7,475,879 B1
(45) Date of Patent: Jan. 13, 2009

(54) PAINTBALL GAMING DEVICE, SYSTEM, AND ASSOCIATED METHODS

(76) Inventors: Enrique Fernandez, 5614 Donnelly Cir., Orlando, FL (US) 32821; Robert J. Alfonso, 1961 Woodbrook St., Tarpon Springs, FL (US) 34689

( * ) Notice: Subject to any disclaimer, the term of this patent is extended or adjusted under 35 U.S.C. 154(b) by 843 days.

(21) Appl. No.: 10/859,049

(22) Filed: Jun. 2, 2004

Related U.S. Application Data

(60) Provisional application No. 60/475,094, filed on Jun. 2, 2003.

(51) Int. Cl.
*F41J 5/00* (2006.01)

(52) U.S. Cl. ..... 273/371; 124/80; 42/94

(58) Field of Classification Search ..... 273/371; 53/453
See application file for complete search history.

(56) References Cited

U.S. PATENT DOCUMENTS

| | | | | |
|---|---|---|---|---|
| 1,477,698 | A | 12/1923 | Emmelin | |
| 1,533,631 | A | 4/1925 | Brownlee | |
| 1,547,834 | A | 7/1925 | Smookler | |
| 2,030,889 | A | 2/1936 | Negrotto | |
| 2,193,547 | A | 3/1940 | Blattmann | |
| 2,429,618 | A | 10/1947 | Haire | |
| 2,430,454 | A | 11/1947 | Cormier | |
| 3,225,656 | A | 12/1965 | Flaherty et al. | |
| 3,990,704 | A | 11/1976 | Meyer et al. | |
| 4,007,554 | A | 2/1977 | Helmstadter | |
| 4,398,447 | A * | 8/1983 | Harris et al. | 89/46 |
| 4,858,359 | A | 8/1989 | Danz | |
| 5,001,880 | A * | 3/1991 | Smith | 53/453 |
| 5,347,740 | A | 9/1994 | Rather et al. | |
| 5,649,706 | A | 7/1997 | Treat, Jr. et al. | |
| 5,913,668 | A * | 6/1999 | Messer | 42/94 |
| 6,286,411 | B1 | 9/2001 | Sanderson | |
| 6,293,179 | B1 | 9/2001 | Sanderson | |
| 6,338,218 | B1 * | 1/2002 | Hegler | 42/94 |
| 6,338,487 | B2 * | 1/2002 | Kang | 273/368 |
| 6,367,466 | B1 * | 4/2002 | Nettles, Jr. | 124/80 |
| 6,574,899 | B1 * | 6/2003 | Mostello | 42/94 |
| 6,584,992 | B2 * | 7/2003 | Brynolf | 134/131 |
| 6,637,708 | B1 * | 10/2003 | Peterson | 248/285.1 |
| 2005/0017456 | A1 * | 1/2005 | Shechter | 273/371 |

* cited by examiner

*Primary Examiner*—Xuan M. Thai
*Assistant Examiner*—Masud Ahmed
(74) *Attorney, Agent, or Firm*—Allen Dyer Doppelt Milbrath & Gilchrist

(57) ABSTRACT

A system for playing a paintball game with fixed paintguns includes target objects. At least some of the target objects include an impact sensor and an element for issuing an alarm if the impact sensor detects an impact. At least some the target objects are movable about the game site. At least one rotatable paintgun mount that is adapted for receiving a paintgun is positioned for aiming a paintgun at the target objects. The paintgun mount has a passageway with an inlet for receiving a gas under pressure and an outlet connectable with a gas inlet port on a paintgun. A hopper has a receptacle for paintballs and a tube that extends from the receptacle to the paintgun mount, which is connectable to an ammunition port.

10 Claims, 6 Drawing Sheets

PAINTBALL GAMING DEVICE, SYSTEM, AND ASSOCIATED METHODS

CROSS-REFERENCE TO RELATED APPLICATION

This application claims priority to provisional application Ser. No. 60/475,094, filed Jun. 2, 2003, entitled "Gun mount for paintball/airsoft shooting gallery for family entertainment centers method and components."

FIELD OF INVENTION

The present invention generally relates to gaming systems, devices, and methods, and, in particular, to systems and methods for operating and playing a shooting-type game such as paintball in a gallery environment.

BACKGROUND OF THE INVENTION

The game of paintball has become increasingly popular in recent years. In a typical game, two teams are pitted against each other to attempt to capture the other team's flag. The paintballs themselves are round, thin-skinned gelatin capsule with a colored liquid inside. Paintguns are loaded with paintballs and powered by a gas such as carbon dioxide or compressed air. Some paintguns are pump-action and some are semi-automatic. When the skin splits open, the liquid inside leaves a bright paint mark, and the marked player is eliminated from the game.

Typically the game is played in the woods or on a "concept field" with obstacles, and thus playing the game is at the mercy of the climatic conditions. Further, in an outdoor arena, the possibility exists of getting lost and of losing track of children. In addition, some players are afraid of being hit with a paintball.

SUMMARY OF THE INVENTION

A first aspect of the present invention is directed to a system for playing a paintball game indoors or in another type of predefined area with fixed paintguns. The paintball gaming system comprises a plurality of target objects. At least some of the target objects comprise an impact sensor and means for issuing an alarm if the impact sensor detects an impact on the target object. At least some the target objects are movable about the game site.

At least one rotatable paintgun mount that is adapted for receiving a paintgun is provided. The paintgun mount is positioned for aiming a paintgun at the target objects. The paintgun mount has a passageway with an inlet that is adapted to receive a gas under pressure and an outlet connectable with a gas inlet port on a paintgun.

A hopper is also provided that comprises a receptacle for paintballs and a tube that extends from the receptacle. The tube is affixable to a paintgun ammunition port when a paintgun is affixed to the mount, for loading the paintgun with paintballs.

A method of the present invention is directed to playing a paintball game. This method comprises the steps of transmitting a start signal to a processor. The processor has software resident thereon for, upon receipt of the start signal, activating a paintgun mounted on a movable paintgun mount and sending a signal to activate a plurality of target objects into motion.

The paintgun is loaded with a plurality of paintballs that are received from a hopper by way of the paintgun mount. The paintgun is moved within a predetermined range of motion to aim the paintgun at a target object. At least one paintball is shot at a target object, and, if a paintball strikes a target object, an impact sensor and an alarm are activated. The shooting is accomplished under gas pressure applied from within the paintgun mount.

Another aspect of the present invention is directed to a method of doing business by operating a paintball game. This method comprises the steps of configuring a paintball gallery as above, and selling a use of the paintball game to a customer.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENT

A description of the preferred embodiments of the present invention will now be presented with reference to FIGS. 1-6.

Figure 1:
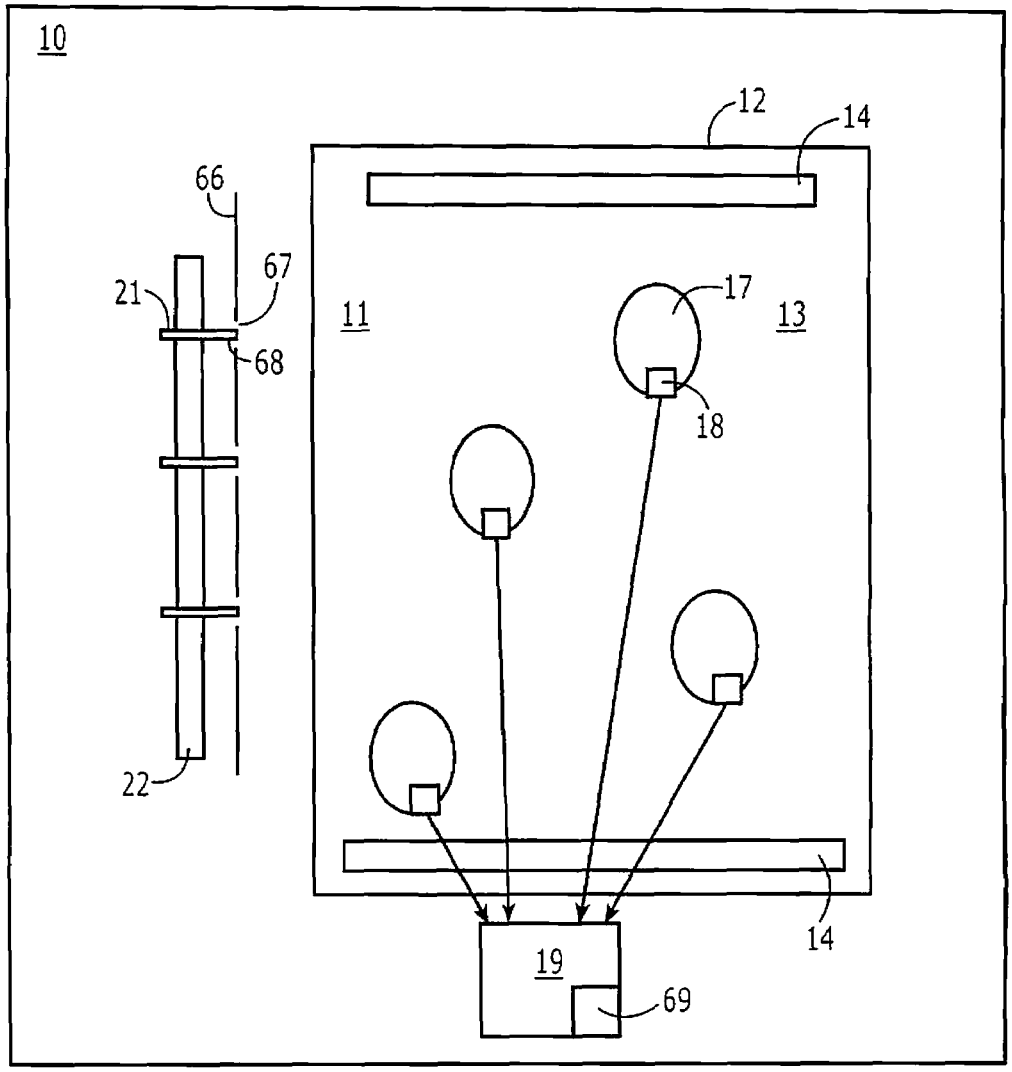
FIG. 1 is a top plan view of an exemplary gaming site.
Figure 2:
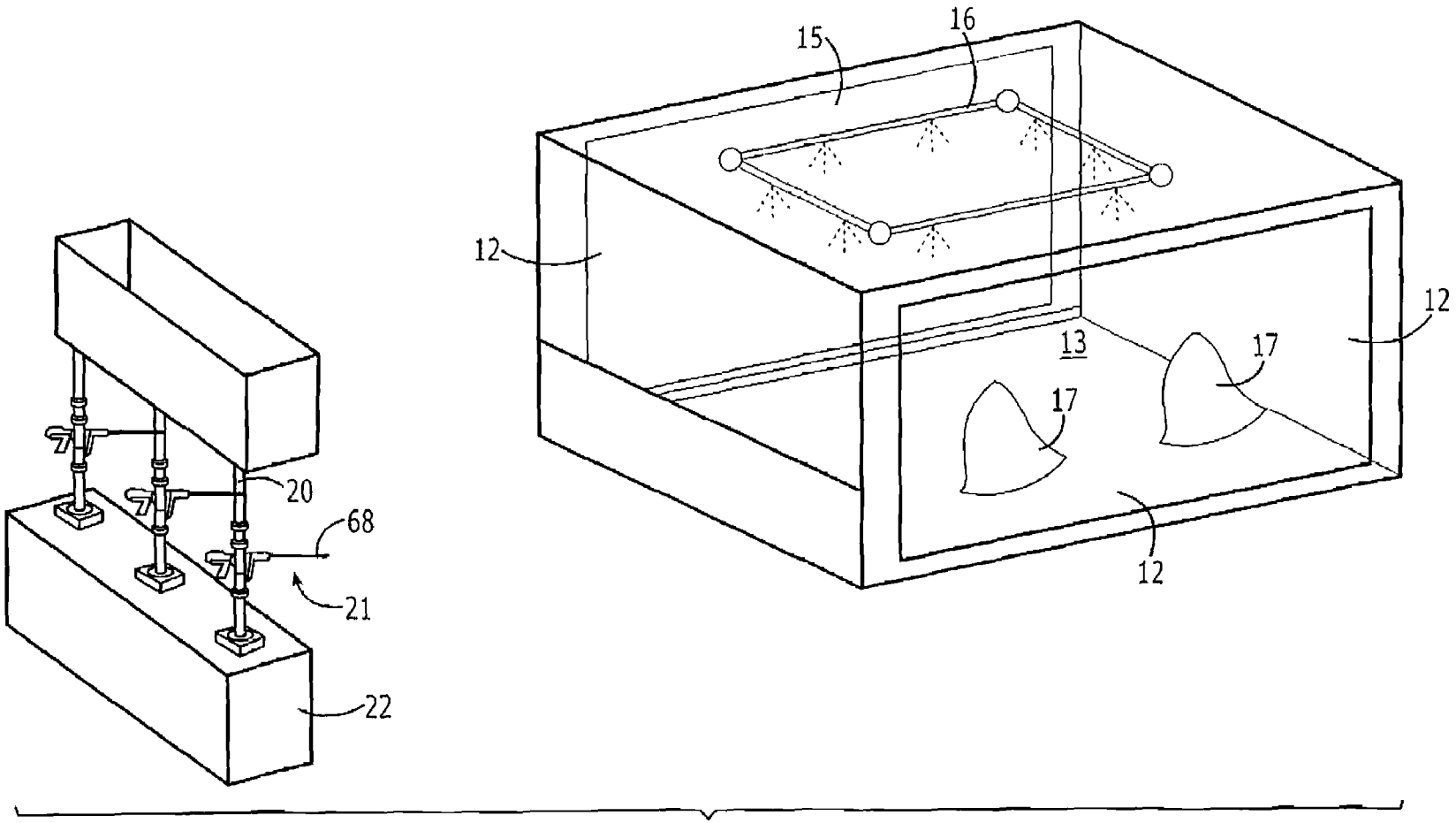
FIG. 2 is a rear-side perspective view of paintguns affixed to mounts for firing within a target enclosure.
Figure 3:
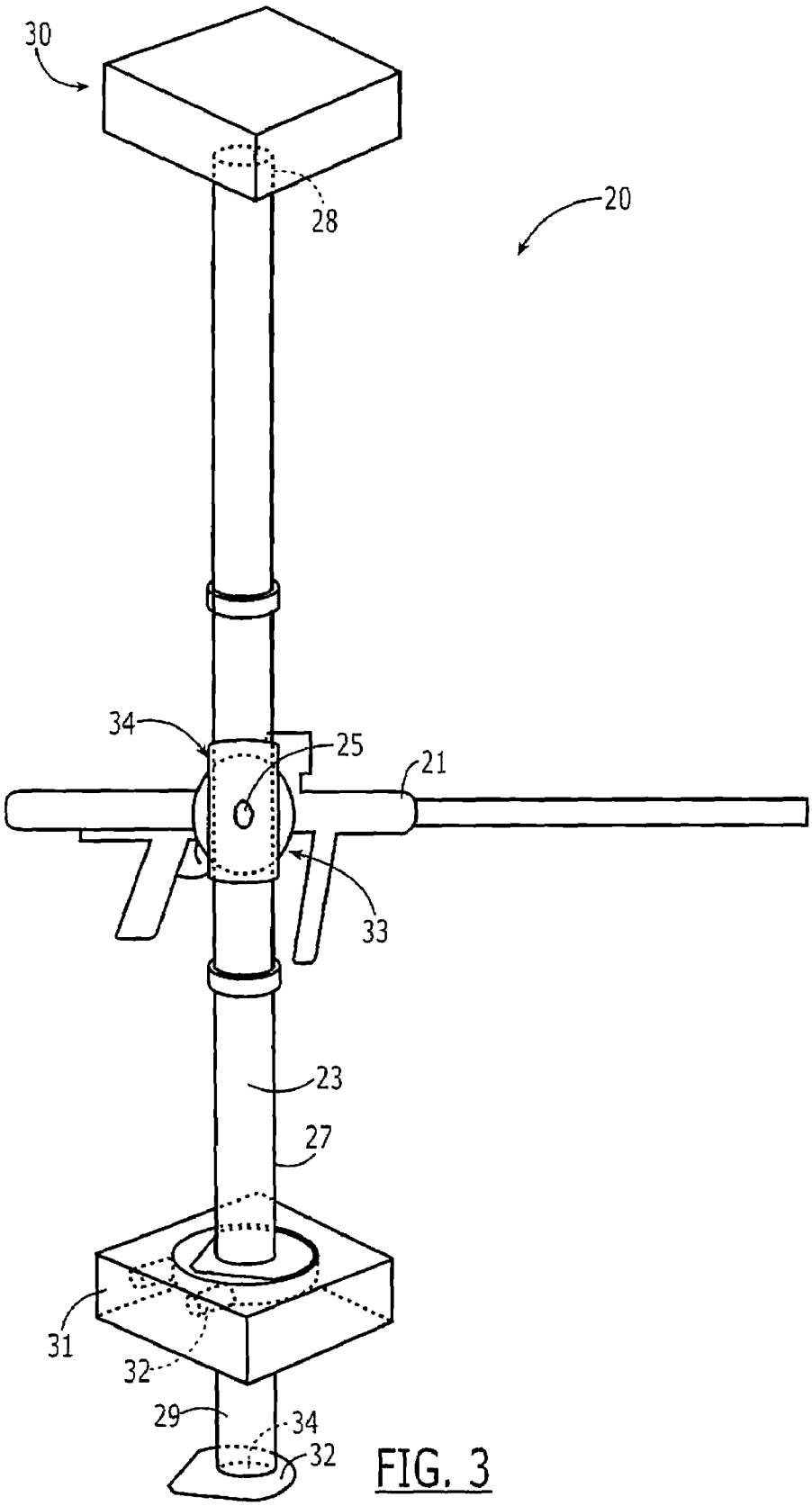
FIG. 3 is a schematic of a first embodiment of a paintgun mount.

The paintball gaming system of the present invention can be constructed de novo, added to an existing installation, or installed outside in, for example, a flexible enclosure. The system, an exemplary embodiment 10 of which is illustrated in FIGS. 1 and 2, comprises elements for placement within a site 11, and may include the site 11 itself. Typically the system 10 includes three walls 12 and a floor 13. Preferably the floor 13 comprises an easily washable material, such as plastic, as well as a network of drains 14. The top 15 has installed therein a sprinkler system 16 for washing the site 11 following the playing of a paintball game.

Also included in the system 10 are a plurality of target objects 17, some of which are movable and some stationary. In an exemplary system, the target objects 17 are inflatable for ease of movement, maintenance, and transport. The movable target objects 17 may be moved about the site 11 using means known in the art such as pneumatic actuators, motor/gear/belt systems, or ball screw actuators, although these are not intended as limitations. In another embodiment, the target objects 17 may be connected to an overhead track such as is used in bumper cars; alternatively, a floor track could be used.

At least some of the target objects 17 comprise at least one impact sensor 18 and means for issuing an alarm, such as a horn- or bell-type alarm, if the impact sensor 18 detects an impact on the target object 17. Preferably, with a system 10 under processor 19 control, the impact sensors 18 transmit a signal to the processor 19, on which software is resident for keeping a count of the number of impacts scored by a player or team. The impact sensors 18 may comprise any pressure-sensing means such as known in the art, including, but not intended to be limited to, mechanical, load cell, or piezoelectric sensors.

At least one rotatable paintgun mount 20 that is adapted for receiving a paintgun 21 is positioned for aiming a paintgun 21 at the target objects 17. Typically a plurality of paintgun mounts 20 are provided, each anchored to a stand 22 of some sort, depending upon the system embodiment. The paintgun mount 20 has a passageway 23 with an inlet 24 that is adapted to receive a gas under pressure and an outlet 25 connectable with a gas inlet port 26 on a paintgun 21.

In a first embodiment (FIG. 3) the mount 20 includes a hollow rod 27 that is anchored at a top end 28 and at a bottom end 29 to the stand 22. The top end 28 is rotatably affixed to a top mounting block 30, which acts as a bearing. The bottom end 29 is rotatably affixed to a bottom mounting block 31, which uses a plurality of set screws 32 to limit rotational travel and provide adjustment for windage. The height of the paintgun mount 20 can also be adjusted to account for a player's height using a slide block 33 movably affixed about the rod 27. To the slide block 33 is affixed a cuff 34 to which a paintgun 21 is affixable, and which is rotatable in a vertical plane for adjusting elevation.

In order to ensure safety, the paintgun 21 is limited in aim by either mechanical or electronic means. In an electronic configuration, a cam and a sensor, such as a sonic, proximity, optical, or mechanical contact sensor, operate to prevent the paintgun 21 from firing if a predetermined vertical plane of the sensor is broken.

Figure 4:
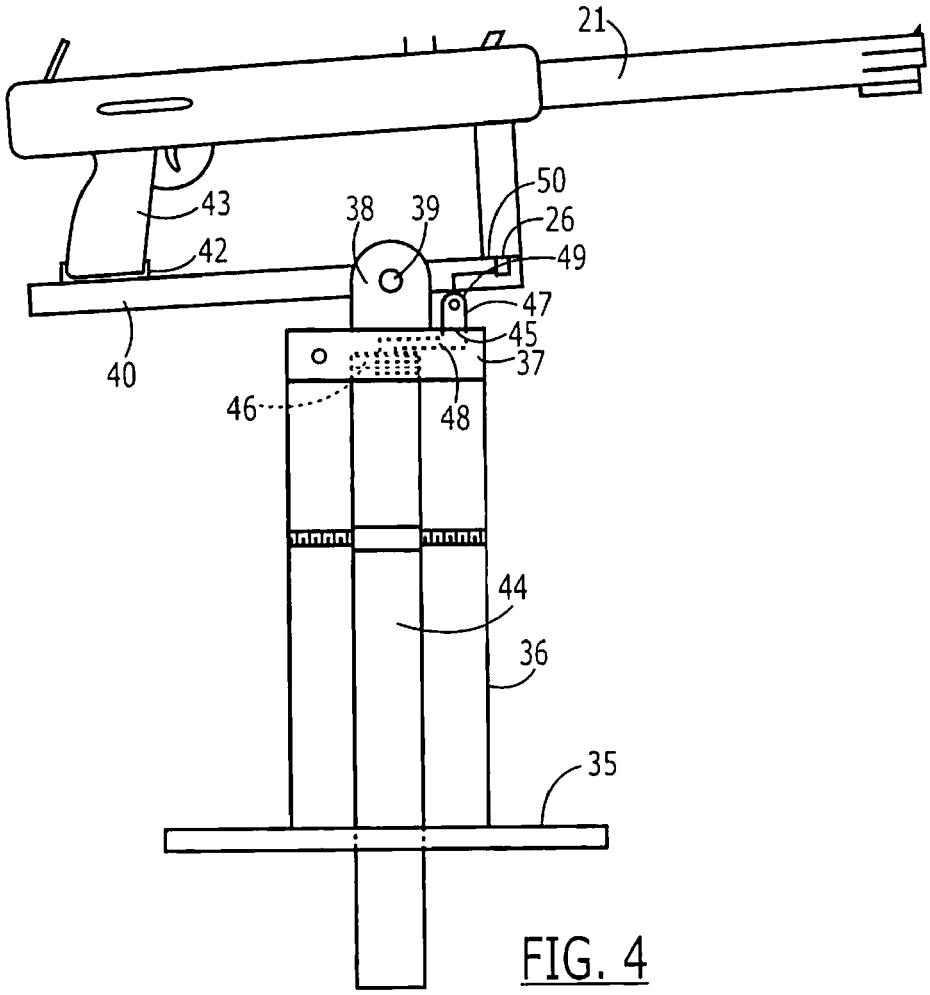
FIG. 4 is a schematic of a second embodiment of a paintgun mount.
Figure 4A:
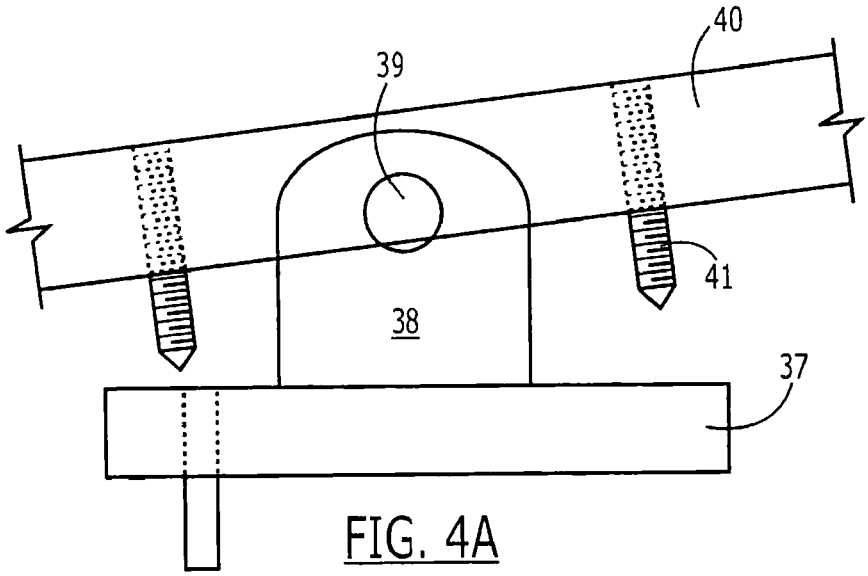
FIG. 4A is a detail view of the elevation adjustment of the second embodiment of FIG. 4.

In a second embodiment (FIG. 4), a base comprises a bottom plate 35 and a substantially cylindrical mounting portion 36, to which is affixed at a top end a rotating top 37. To the rotating top 37 is affixed a bracket 38 having a pivot mount 39. A paintgun mounting plate 40 is thereby pivotably affixed to the bracket 38, and the paintgun mounting plate 40 is adjustable for windage, as shown in FIG. 4A, limited by set screws 41. A paintgun 21 is affixable to the paintgun mounting plate 40 at the bottom ends 42 of its handles 43. A paintball and gas passage is created by a hollow rod 44 that extends through the bottom plate 35, through the cylindrical mounting portion 36, and into the rotating top 37. The rotating top 37 has a first passage 45 that meets the rod's top end 46 and extends upward to a top opening 47, where a tube 48 joins and extends to the paintgun mounting plate 40. A second passage 49 extends through the paintgun mounting plate 40 and into a paintball inlet 50 in the paintgun 21.

Figure 5:
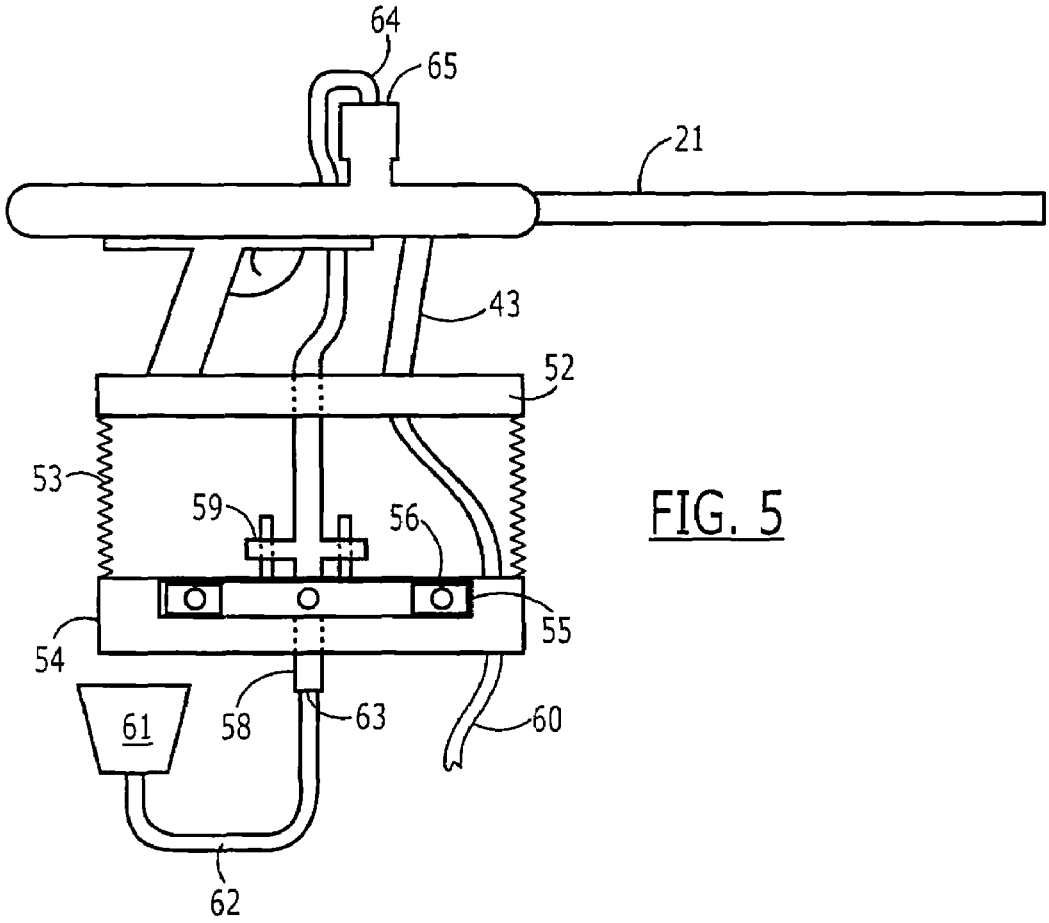
FIG. 5 is a schematic of a third embodiment of a paintgun mount.
Figure 5A:
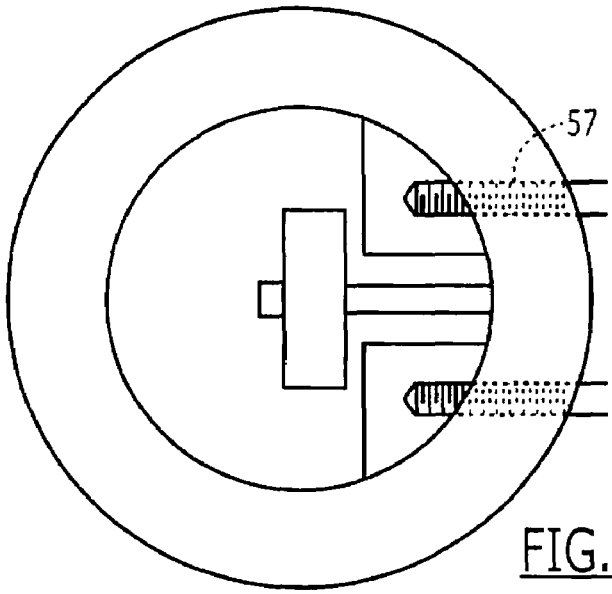
FIG. 5A is a detailed view of the paintgun mount embodiment of FIG. 5 showing the windage adjustment mechanism.

In a third embodiment (FIG. 5), the paintgun handles 43 are affixed to a top plate 52, which is connected by a flexible bellows 53 to a bottom plate 54. The bottom plate 54 has a recess 55, in which is positioned an inner plate 56 through which extend set screws 57 for providing windage adjustment (FIG. 5A). Elevation adjustment is accomplished by means of rod 58 that extends through the bottom plate 54 with set screws 59. An air hose 60 extends inside the bellows 53, through the top plate 52, and into the paintgun 21.

Figure 6:
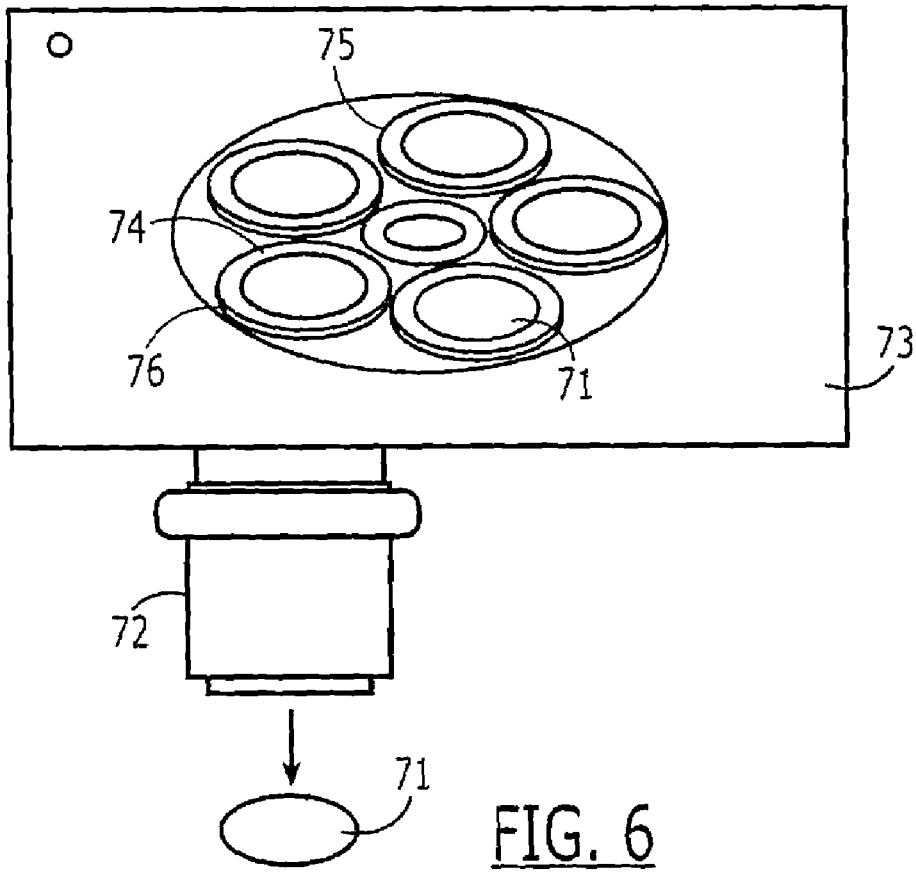
FIG. 6 is a top view of a motor mount for feeding paintballs from a paintball hopper.

A hopper 61 comprises a receptacle for paintballs and a tube 62 extending from the receptacle to an aperture 63 in the paintgun mount 20. A second end 64 of the aperture 63 is connectable to a paintgun ammunition port 65 when a paintgun 21 is affixed to the mount 20, for loading the paintgun 21 with paintballs. The hopper 61 is adapted to provide either a continuous feed of paintballs to a paintgun 21, or to deliver a predetermined number of paintballs to a paintgun 21. An exemplary motor mount 70 is illustrated in FIG. 6, wherein five paintballs 71 drop by gravity feed into the motor mount 70, which is rotated by a motor, and then drop through tube 72 into the paintgun 21. The motor mount 70 includes a base 73 having a substantially cylindrical depression 74 therein, in which resides a five-bladed propelling means 75. Each of the blades 75 is curved commensurate with the circumference of a paintball 71. The base 73 also has an outlet 76 positioned within and adjacent the periphery of the depression 74, the outlet 76 sized to accommodate one paintball 71. When the propelling means 75 spins, one paintball 71 at a time is moved over the outlet 76 and falls through the tube 72.

Delivering a predetermined number of paintballs 71 to a paintgun 21 may be accomplished in a number of ways. For example, knowing the revolutions per minute of the motor, one can calculate the number of paintballs 71 fed per unit time, since five paintballs 71 are fed per revolution. In a second embodiment, a photoeye can be used to count the number of paintballs 71 as they pass, and, once a predetermined number are counted, the motor is stopped. In a third embodiment, a stepper motor having an encoder incorporated is used to ensure that a predetermined number of paintballs 71 are delivered. These embodiments are not intended to be limiting, and one of skill in the art will recognize that alternate methods of delivering paintballs may be contemplated.

In a particular embodiment, between the paintgun mount 20 and the target objects 17 is positioned a barrier 66, which has an aperture 67 for permitting a paintgun barrel 68 to protrude therethrough. The barrier 66 provides an additional safety feature by preventing paintballs to be ejected into an area outside the site 11 where other people may be present.

In a method of playing a paintball game of the present invention, a start signal is transmitted to a processor 19. The processor 19 has software 69 resident thereon for, upon receipt of the start signal, activating a paintgun 21 mounted on a movable paintgun mount 20 and sending a signal to activate a plurality of target objects 17 into motion. The paintgun 21 is loaded with a plurality of paintballs received from a hopper 61 by way of the paintgun mount 20. The paintgun 21 is moved within a predetermined range of motion to aim the paintgun 21 at a target object 17. At least one paintball is shot at a target object 17, so that, if a paintball strikes a target object 17, an impact sensor and an alarm are activated, wherein the shooting is accomplished under gas pressure applied from within the paintgun mount 20.

Another aspect of the present invention is directed to a method of operating a paintball game. This method comprises the steps of configuring a paintball gallery 10 as described above, selling a use of the paintball game 10 to a customer, loading the paintgun 21 with paintballs, activating the moving means to move the target objects 17, and activating the paintgun 21.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A paintball gaming system comprising:

a plurality of target objects, at least some of the target objects comprising at least one impact sensor and means for issuing an alarm if the impact sensor detects an impact on the target object;

means for moving at least some of the target objects about a site;

at least one rotatable paint gun mount adapted for receiving a paint gun and positioned for aiming a paint gun at the target objects, the paint gun mount having a passageway with an inlet adapted to receive a gas under pressure and an outlet connectable with a gas inlet port on a paint gun, the paint gun mount is adapted to receive an electronic paint gun, and further comprising a paint gun position sensor and means for deactivating the paint gun if the paint gun position sensor indicates that the paint gun has moved to a disallowed orientation;

a hopper comprising a receptacle for paintballs and a tube extending from the receptacle and affix able to a paint gun ammunition port when a paint gun is affixed to the mount, for delivering a predetermined number of paintballs to the paint gun; and a washing system configured to, when a game is finished, automatically wash down the target objects.

2. The paintball gaming system recited in claim 1, wherein the impact sensor comprises one of a pressure sensor and a mechanical sensor.

3. The paintball gaming system recited in claim 1, wherein the paintgun mount comprises means for limiting a rotation of a paintgun mounted thereon to a predetermined angular range.

4. The paintball gaming system recited in claim 1, wherein the paintgun mount comprises height-adjustment means.

5. The paintball gaming system recited in claim 1, wherein the paintgun mount comprises means for adjusting a position of a paintgun mounted thereon for windage and elevation.

6. The paintball gaming system recited in claim 1, further comprising a base for supporting the target objects and a barrier between the base and the paintgun mount for preventing human access to the base, the barrier having an aperture configured to admit a barrel of a paintgun.

7. The paintball gaming system recited in claim 1, further comprising a control system for, upon receipt of a start signal, activating the moving means and for keeping score based upon a number of times the impact sensor detects an impact on a target object.

8. A method of controlling a paintball gaming system comprising the steps of:

transmitting a start signal to a processor, the processor having software resident thereon for, upon receipt of the start signal, activating a paint gun mounted on a movable paint gun mount and sending a signal to activate a plurality of target objects into motion;

loading the paint gun with a predetermined number of paintballs received from a hopper by way of the paint gun mount;

moving the paint gun within a predetermined range of motion to aim the paint gun at a target object, wherein the paint gun mount is provided with a paint gun position sensor and means for deactivating the paint gun if the paint gun position sensor indicates that the paint gun has moved to a disallowed orientation;

permitting a customer to shoot at least one paintball at a target object, a paintball striking a target object activating an impact sensor and an alarm, the paintball propelled under gas pressure applied from within the paint gun mount; and after a game is finished, automatically initiating a washing down of the target objects.

9. The method recited in claim 8, further comprising the step of determining an orientation of the paintgun, and, if the orientation is outside the predetermined range of motion, deactivating the paintgun.

10. The method recited in claim 8, further comprising the step of counting a number of times a paintball strikes a target object.

* * * * *